US007442482B2

(12) United States Patent
Eida

(10) Patent No.: US 7,442,482 B2
(45) Date of Patent: Oct. 28, 2008

(54) PROCESS FOR PREPARING TONER

(75) Inventor: Akihiro Eida, Wakayama (JP)

(73) Assignee: Kao Corporation, Tokyo (JP)

( * ) Notice: Subject to any disclaimer, the term of this patent is extended or adjusted under 35 U.S.C. 154(b) by 446 days.

(21) Appl. No.: 11/227,191

(22) Filed: Sep. 16, 2005

(65) Prior Publication Data

US 2006/0063090 A1 Mar. 23, 2006

(30) Foreign Application Priority Data

Sep. 21, 2004 (JP) ..... 2004-274115

(51) Int. Cl.
*G03G 9/08* (2006.01)

(52) U.S. Cl. ..... 430/110.4; 430/137.2

(58) Field of Classification Search ..... 430/110.4, 430/137.2

See application file for complete search history.

(56) References Cited

U.S. PATENT DOCUMENTS

| | | | | |
|---|---|---|---|---|
| 6,171,744 | B1 * | 1/2001 | Nakazawa et al. | 430/108.6 |
| 6,326,119 | B1 * | 12/2001 | Hollenbaugh et al. | 430/137.2 |
| 7,078,144 | B2 * | 7/2006 | Ota et al. | 430/137.2 |
| 2005/0233236 | A1 | 10/2005 | Eida et al. | |
| 2005/0233237 | A1 | 10/2005 | Eida et al. | |
| 2005/0233238 | A1 | 10/2005 | Eida et al. | |

OTHER PUBLICATIONS

Patent Abstracts of Japan, JP 2002-365847A, Dec. 18, 2002.
Patent Abstracts of Japan, JP 2003-076056A, Mar. 14, 2003.
U.S. Appl. No. 11/228,259, filed Sep. 19, 2005, Eida.
U.S. Appl. No. 11/423,792, filed Jun. 13, 2006, Eida, et al.

* cited by examiner

*Primary Examiner*—John L Goodrow
(74) *Attorney, Agent, or Firm*—Oblon, Spivak, McClelland, Maier & Neustadt, P.C.

(57) ABSTRACT

A process for preparing a toner including the steps of (I) melt-kneading a raw material mixture containing a resin binder, a wax, and a colorant with an open-roller type kneader; (II) cooling the melt-kneaded mixture obtained in the step (I) and pulverizing the cooled mixture; and (III) classifying the pulverized product obtained in the step (II) to give a toner, wherein the wax is contained in the toner in an amount of from 2 to 15% by weight, and has a number-average particle size in the toner of 1 μm or less, wherein the toner has a volume-median particle size ($D_{50}$) of from 3.5 to 7 μm, and a standard deviation in volume base particle size distribution of ¼ of $D_{50}$ or less, and contains 5% by volume or less of particles having particle sizes of ($1.4 \times D_{50}$) μm or more, and 5% by number or less of particles having particle sizes of 3 μm or less. The toner can be used, for instance, for the development of a latent image formed in electrophotography, electrostatic recording method, electrostatic printing method or the like.

20 Claims, No Drawings

PROCESS FOR PREPARING TONER

FIELD OF THE INVENTION

The present invention relates to a process for preparing a toner used for, for example, developing an electrostatic latent image formed in electrophotography, electrostatic recording method, electrostatic printing method, or the like.

BACKGROUND OF THE INVENTION

In full-color printers, high-image qualities can be produced by preparing a toner having a smaller particle size because full-color fixed images are formed by layering toners having three or more plural colors. On the other hand, in full-color printers, an oil is conventionally applied to a fixing roller thereof for the purpose of preventing offset. However, since paper is not stained by the oil, a fixing system without applying an oil or applying a very small amount of an oil has become mainstream. Although a means for containing a large amount of a wax in a toner in such a system has been proposed, the wax contained in a large amount in the toner lowers the fluidity of the toner, and worsens the pulverizability during the preparation of the toner. Therefore, when a toner having a small particle size and a sharp particle size distribution is prepared, pulverization and classification of a kneaded product are likely to be difficult.

On the other hand, in order to obtain a toner according to pulverization method having improved dispersibility of a wax, a toner prepared by using a dispersion aid for a wax (see JP2002-365847 A), a process for increasing the number of times of kneading a wax (see JP2003-76056 A), and the like have been known.

SUMMARY OF THE INVENTION

The present invention relates to:

[1] a process for preparing a toner including the steps of:

(I) melt-kneading a raw material mixture containing a resin binder, a wax, and a colorant with an open-roller type kneader;

(II) cooling the melt-kneaded mixture obtained in the step (I) and pulverizing the cooled mixture; and (III) classifying the pulverized product obtained in the step (II) to give a toner, wherein the wax is contained in the toner in an amount of from 2 to 15% by weight, and has a number-average particle size in the toner of 1 μm or less, wherein the toner has a volume-median particle size ($D_{50}$) of from 3.5 to 7 μm, and a standard deviation in volume base particle size distribution of ¼ of $D_{50}$ or less, and contains 5% by volume or less of particles having particle sizes of ($1.4 \times D_{50}$) μm or more, and 5% by number or less of particles having particle sizes of 3 μm or less;

[2] a toner containing a resin binder, a colorant and a wax, wherein the wax is contained in the toner in an amount of from 2 to 15% by weight, and has a number-average particle size in the toner of 1 μm or less, wherein the toner has a volume-median particle size ($D_{50}$) of from 3.5 to 7 μm, and a standard deviation in volume base particle size distribution of the toner is ¼ of $D_{50}$ or less, and contains 5% by volume or less of particles having particle sizes of ($1.4 \times D_{50}$) μm or more, and contains 5% by number or less of particles having particle sizes of 3 μm or less; and

[3] a process for forming fixing images, including the step of fixing the toner as defined in the above item [2] by an oil-less fixing process.

DETAILED DESCRIPTION OF THE INVENTION

The present invention relates to a process for efficiently preparing a toner having a small particle size and a sharp particle size distribution, wherein the toner has excellent dot reproducibility in a continuous printing.

According to the present invention, a toner having a small particle size and a sharp particle size distribution, wherein the toner has excellent dot reproducibility in a continuous printing, can be obtained.

These and other advantages of the present invention will be apparent from the following description.

As a result of studies on the lowering of pulverizability and classification precision by containing a wax, the present inventors have considered that when a wax has a large particle size of dispersed phases, toners are easily crushed on the interface between a resin binder and the wax, whereby a large amount of wax components are exposed on the surface of the toner, so that fluidity and dispersibility in a pulverizer and a classifier become worse, thereby lowering the efficiency in pulverization and classification. Moreover, the present inventors have found that since the phenomena become even more remarkable when the toner is pulverized into smaller particle sizes, in the preparation of a toner having a small particle size and a sharp particle size distribution, the adjustment of particle sizes of dispersed phases of a wax even more become an important factor.

One of the features of the present invention resides in the adjustment of an average particle size of the wax in the toner. Specifically, the toner obtained according to the present invention contains a wax having a number-average particle size of 1 μm or less, and preferably from 0.05 to 0.6 μm. When the wax in the toner is adjusted so as to have an average particle size within the above-mentioned range, a toner having a small particle size and a sharp particle size distribution can be obtained even by the pulverization method.

The process for preparing a toner of the present invention includes at least the steps of:

(I): melt-kneading a raw material mixture containing a resin binder, a wax, and a colorant;

(II): cooling the melt-kneaded mixture obtained in the step (I) and pulverizing the cooled mixture; and (III): classifying the pulverized product obtained in the step (II) to give a toner.

Each of the steps will be explained hereinbelow.

The step (I) is a step of melt-kneading a raw material mixture containing a resin binder, a wax, and a colorant.

The resin binder includes polyesters, styrene-acrylic resins, a mixed resin of a polyester and a styrene-acrylic resin, a hybrid resin containing two or more resin components, and the like. The resin binder containing a polyester as a main component is preferable, from the viewpoint of dispersibility and transparency of the colorant. The polyester is contained in the resin binder in an amount of preferably from 50 to 100% by weight, and more preferably from 70 to 100% by weight. As the hybrid resin, a resin in which a polycondensation resin, such as a polyester, a polyester-polyamide or a polyamide, and an addition polymerization resin such as a vinyl polymer-based resin are partially chemically bonded to each other is preferable. The hybrid resin may be obtained by using two or more resins as raw materials, or the hybrid resin may be obtained by using a mixture of one kind of resin and raw material monomers for the other resin. In order to efficiently obtain a hybrid resin, those obtained from a mixture of raw material monomers of two or more resins are preferable.

The raw material monomer for the polyester is not particularly limited, as long as a known alcohol component and a known carboxylic acid component such as carboxylic acids, acid anhydrides thereof and esters thereof are used.

The alcohol component includes an alkylene (2 or 3 carbon atoms) oxide (average number of moles: 1 to 16) adduct of bisphenol A, such as polyoxypropylene(2.2)-2,2-bis(4-hydroxyphenyl)propane and polyoxyethylene(2.2)-2,2-bis(4-hydroxyphenyl)propane; ethylene glycol, propylene glycol, glycerol, pentaerythritol, trimethylolpropane, hydrogenated bisphenol A, sorbitol, or an alkylene (2 to 4 carbon atoms) oxide (average number of moles: 1 to 16) adduct thereof; and the like.

In addition, the carboxylic acid component includes dicarboxylic acids such as phthalic acid, isophthalic acid, terephthalic acid, fumaric acid, maleic acid, adipic acid, and succinic acid; a substituted succinic acid of which substituent is an alkyl group having 1 to 20 carbon atoms or an alkenyl group having 2 to 20 carbon atoms, such as dodecenylsuccinic acid or octenylsuccinic acid; tricarboxylic or higher polycarboxylic acids such as 1,2,4-benzenetricarboxylic acid (trimellitic acid) and pyromellitic acid; acid anhydrides thereof, alkyl (1 to 3 carbon atoms) esters thereof, and the like.

The polyester can be prepared by, for example, polycondensation of the alcohol component and the carboxylic acid component at a temperature of from 180° to 250° C. in an inert gas atmosphere in the presence of an esterification catalyst as desired.

The polyester has an acid value of preferably from 5 to 40 mg KOH/g, more preferably from 10 to 35 mg KOH/g, and even more preferably from 15 to 30 mg KOH/g.

In addition, the polyester has a softening point of preferably from 80° to 165° C. and a glass transition temperature of preferably from 50° to 85° C.

The wax includes natural ester waxes such as carnauba wax and rice wax; synthetic waxes such as polypropylene wax, polyethylene wax and Fischer-Tropsch wax; petroleum waxes such as paraffin waxes; coal waxes such as montan wax; alcohol waxes; and the like. Among them, natural ester waxes and petroleum waxes are preferable, and a combined use of the natural ester wax and the petroleum wax is more preferable, from the viewpoint of preventing offset. These waxes may be contained alone or in admixture of two or more kinds.

The wax has a melting point of preferably from 50° to 120° C., and more preferably from 60° to 120° C., from the viewpoint of low-temperature fixing ability and offset resistance.

The wax is contained in an amount of from 2 to 15% by weight, and preferably from 4 to 10% by weight, in the toner, from the viewpoint of offset resistance and durability. Usually, when the wax is used in a large amount, the pulverized product is easily fused to each other during the pulverization, thereby making it likely to lower the pulverization efficiency. In the present invention, even when the wax is used in a somewhat larger amount, the toner can be efficiently pulverized.

As the colorants, all of the dyes, pigments, and the like which are used as colorants for toners can be used. The colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner prepared according to the present invention may be any of black toners and color toners. The amount of the colorant contained is preferably from 1 to 40 parts by weight, and more preferably from 3 to 10 parts by weight, based on 100 parts by weight of the resin binder.

In the present invention, additives such as charge control agents, fluidity improvers, electric conductivity modifiers, extenders, reinforcing fillers such as fibrous substances, antioxidants, anti-aging agents, cleanability improvers, and magnetic materials may be further contained as raw materials in the toner.

It is preferable that the raw materials such as a resin binder, a wax, and a colorant are previously mixed with a Henschel mixer or the like and subjected to melt-kneading. Especially, it is desired that a resin binder and a wax are mixed before the step (I) under the condition that the value of (Froude number of mixer×agitation time (s)), i.e., Fr·t, is preferably from 10,000 to 30,000, and more preferably from 10,000 to 20,000. The Fr·t can be adjusted within the above-mentioned range by shortening the agitation time when the Froude number is large, i.e., the agitation force is large, or lengthening the agitation time when the Froude number is small, i.e., the agitation force is small.

Here, in the present invention, the Froude number (Fr) is a value calculated from the following formula:

$$Fr = \frac{(\text{Peripheral Speed of Agitation Blade})^2\ [\text{m}^2/\text{s}^2]}{\text{Diameter of Agitation Blade [m]} \times \text{Acceleration of Gravity [9.8 m/s}^2]}$$

In the present invention, the raw material mixture is melt-kneaded with an open-roller type kneader. The wax can be efficiently obtained in high dispersion with the open-roller type kneader, without a repeat of the kneading or without a dispersion aid.

The open-roller type kneader in the present invention refers to a kneader containing at least two rollers, and a melt-kneading member is an open type, and it is preferable that at least two of the rollers are a heat roller and a cooling roller. The open-roller type kneader can easily dissipate the kneading heat generated during the melt-kneading. In addition, it is preferable that the open-roller type kneader is a continuous type kneader, from the viewpoint of production efficiency.

Further, in the above-mentioned open-roller type kneader, two of the rollers are arranged in parallel closely to each other, and the gap between the rollers is preferably from 0.01 to 5 mm, and more preferably from 0.05 to 2 mm, from the viewpoint of reducing the particle size of the dispersed phases of the wax in the resulting toner. In addition, structures, sizes, materials, and the like of the roller are not particularly limited. Also, the roller surface may be any of smooth, wavy, rugged or other surfaces.

The number of rotations of the roller, i.e. the peripheral speed of the roller, is preferably from 2 to 100 m/min. The peripheral speed of the cooling roller is preferably from 2 to 100 m/min, more preferably from 10 to 60 m/min, and even more preferably 15 to 50 m/min. In addition, it is preferable that the two rollers have different peripheral speeds from each other, and that the ratio of the peripheral speed of the two rollers (cooling roller/heat roller) is preferably from 1/10 to 9/10, and more preferably from 3/10 to 8/10.

In order to facilitate adhesion of the kneaded product to the heat roller, it is preferable that the temperature of the heat roller is adjusted to be higher than both the softening point of the resin binder and the melting point of the wax, and that the temperature of the cooling roller is adjusted to be lower than both the softening point of the resin binder and the melting point of the wax. Specifically, the temperature of the heat roller is preferably from 80° to 200° C., and the temperature of the cooling roller is preferably from 20° to 140° C.

The difference in temperature between the heat roller and the cooling roller is preferably from 60° to 150° C., and more preferably from 80° to 120° C.

Here, the temperature of the roller can be adjusted by, for example, a temperature of a heating medium passing through the inner portion of the roller, and each roller may be divided in two or more portions in the inner portion of the roller, each being communicated with heating media of different temperatures.

It is preferable that the temperature of the heat roller, especially the raw material feeding side of the heat roller, is adjusted to be higher than both the softening point of the resin binder and the melting point of each wax, more preferably a temperature calculated from the temperature higher than the higher of the softening point of the resin binder and the melting point of each wax plus 0° to 80° C., and even more preferably a temperature calculated from the temperature plus 5° to 50° C. It is preferable that the temperature of the cooling roller is adjusted to be lower than both of the softening point of the resin binder and the melting point of each wax, more preferably a temperature calculated from the temperature lower than the lower of the softening point of the resin binder and the melting point of each wax minus 0° to 80° C., and even more preferably a temperature calculated from the temperature minus 40° to 80° C.

The step (II) is a step of cooling the melt-kneaded mixture obtained in the step (I) and pulverizing the cooled mixture.

The temperature to which the melt-kneaded mixture is cooled is not particularly limited, as long as the melt-kneaded mixture is properly cooled to a pulverizable hardness.

The melt-kneaded mixture cooled in the step (II) may be pulverized once or in divided plural times. It is preferable that the pulverization includes rough pulverization and fine pulverization, from the viewpoint of pulverization efficiency and production efficiency. It is preferable that the melt-kneaded mixture is previously roughly pulverized to give a volume-median particle size ($D_{50}$) of from 10 to 1000 μm or so, and thereafter the resulting roughly pulverized product is further finely pulverized in consideration of the particle size of the desired toner.

The step of roughly pulverizing the cooled mixture can be carried out with Atomizer, Rotoplex, or the like.

The pulverizer usable in the step of finely pulverizing the roughly pulverized product includes a jet type pulverizer such as a fluidized bed type jet mill and a gas stream type jet mill; a mechanical pulverizer such as a turbo mill; and the like. From the viewpoint of further remarkably exhibiting the effect of dispersing the wax in the specified particle size of the present invention, the jet type pulverizer is preferable, The fluidized bed type jet mill usable in the present invention includes, for example, a pulverizer having the structure and principle for finely pulverizing the particles, containing at least a pulverization chamber arranged facing two or more jet nozzles in its lower portion thereof, in which a fluidized bed is formed with the particles fed into the pulverizing container by a high-speed gas jet stream discharged from the jet nozzles wherein the particles are finely pulverized by repeating the acceleration of the particles and impact between the particles.

In the jet mill having the above-mentioned structure, the number of jet nozzles is not particularly limited. It is preferable that two or more jet nozzles, and preferably from 3 to 4 jet nozzles are arranged facing each other, from the viewpoint of balance between volume of air, amount of flow and flow rate, impact efficiency of the particles, and the like.

Further, a classifying rotor for capturing uplifted particles having small particle sizes downsized by pulverization is provided in an upper part of the pulverization chamber. The particle size distribution can be easily adjusted by a rotational speed of the classifying rotor. The finely pulverized product (classified powder obtained by cutting off its upper limit) can be obtained by classifying the pulverized product with the classifying rotor.

The classifying rotor may be arranged in any of longitudinal direction and latitudinal direction against the vertical direction. It is preferable that the classifying rotor is arranged in the longitudinal direction, from the viewpoint of classifying performance.

Specific examples of a fluidized bed type jet mill containing two or more jet nozzles and further containing a classifying rotor include pulverizers disclosed in JP-A-Showa-60-166547 and JP2002-35631 A.

The fluidized-bed jet mill which may be preferably used in the present invention includes the "TFG" Series commercially available from Hosokawa Micron Corporation, the "AFG" Series commercially available from Hosokawa Micron Corporation, and the like.

In addition, the gas stream type jet mill includes, for example, an impact type jet mill containing a venturi nozzle and an impact member arranged so as to face the venturi nozzle, and the like.

The gas stream type jet mill which may be preferably used in the present invention includes the "IDS" Series commercially available from Nippon Pneumatic Mfg. Co., Ltd., and the like.

The pulverized product obtained in the step (II) has a particle size of preferably from 3 to 6.5 μm, and more preferably from 3.5 to 6 μm, from the viewpoint of productivity in the step (III).

The step (III) is a step of classifying the pulverized product obtained in the step (II).

The classifier usable in the step (III) includes air classifiers, rotor type classifiers, sieve classifiers, and the like. In the present invention, it is preferable that the classifier contains a classifying rotor containing a driving shaft arranged in a casing as a central shaft thereof in a vertical direction, and a stationary spiral guiding vane arranged to share the same central shaft as the classifying rotor, wherein the stationary spiral guiding vane is arranged in a classification zone on an outer circumference of the classifying rotor with a given spacing to the outer circumference of the classifying rotor, from the viewpoint of ability of removing fine powders. Specific examples of the classifier having the structure described above include a classifier shown in FIG. 2 of JP-A-Hei-11-216425, a classifier shown in FIG. 6 of JP2004-78063 A, commercially available classifiers such as the "TSP" Series commercially available from Hosokawa Micron Corporation, and the like. The classification mechanism will be schematically explained hereinbelow.

The pulverized product fed into a casing of a classifier descends along a classification zone on the outer circumference of the classifying rotor while being led by the spiral guide vane. The inner part of the classifying rotor and the classification zone are communicated via a classifying vane provided on the surface of the outer circumference of the classifying rotor. When the pulverized product is descended, fine powders carried along with a classifying air are aspirated to the inner part of the classifying rotor via the classifying vane, and discharged from a discharging outlet for fine powders. On the other hand, coarse powders that are not carried along with the classifying air are descended along the classification zone by gravitational force, and discharged from a discharging outlet for coarse powders.

Further, it is preferable that the classifier usable in the step (III) has two classifying rotors sharing the same driving shaft as a central shaft thereof in one casing, and that each of the classifying rotors independently rotates in the same direction. Specific examples of the classifiers provided with a classifying rotor on each of two top and bottom stages include a classifier shown in FIG. 1 of JP2001-293438 A, commercially available classifiers such as the "TTSP" Series commercially available from Hosokawa Micron Corporation, and the like.

When a classifying rotor is provided on each of two top and bottom stages, it is more preferable because an even higher precision classification can be achieved by adjusting an aspiration rate of classifying air, a rotational speed in each classifying rotor, or the like.

For example, the ratio of the rotational speed of the upper classifying rotor to the rotational speed of the lower classifying rotor (the rotational speed of the upper classifying rotor/the rotational speed of the lower classifying rotor) is preferably from 1/1.05 to 1.05/1, and more preferably 1/1, from the viewpoint of preventing turbulence.

In addition, it is preferable that the amount of air flow led from an upper air aspiration inlet to the amount of air flow led from a lower air aspiration inlet is nearly equal, from the viewpoint of classification precision and yield of toner.

It is preferable that the classifier usable in the step (III) is mainly used in the classification on the fine powder side (classification to cut off its lower limit) in order to remove fine powders. The fine powders removed during the classifying step may be subjected to the step (III) so as to recapture the necessary portion of the fine powders by re-classification.

The toner of the present invention can be obtained at least through the above-mentioned steps (I) to (III), and an external additive may further be added to the toner obtained by the step (III).

The external additive is preferably an inorganic oxide such as silica, titania, alumina, zinc oxide, magnesium oxide, cerium oxide, iron oxide, copper oxide, or tin oxide. Among them, silica is preferable, from the viewpoint of giving chargeability.

Fine powders of silica ($SiO_2$) may be prepared by any of dry method or wet method. In addition, besides anhydrous silica, the fine powders of silica may be aluminum silicate, sodium silicate, potassium silicate, magnesium silicate or zinc silicate, of which $SiO_2$ content is 85% by weight or more is preferable.

In addition, the surface of the external additive may be subjected to hydrophobic treatment. The hydrophobic treatment method is not particularly limited. The hydrophobic treatment agent includes silane coupling agents such as hexamethyl disilazane (HMDS) and dimethyl dichlorosilane (DMDS); silicone oil treatment agents such as dimethyl silicone oil and amino-modified silicone oil; and the like. Among them, silane coupling agents are preferable. The amount treated by the hydrophobic treatment agent is preferably from 1 to 7 $mg/m^2$ per surface area of the external additive.

The external additive has an average particle size of preferably from 8 to 200 nm, and more preferably from 12 to 100 nm, from the viewpoint of adhesion to the surface of the toner. Here, the average particle size is a number-average particle size.

In the present invention, as mentioned above, since the particle size of the dispersed phases of the wax is adjusted, a toner having a small particle size and a sharp particle size distribution can be obtained.

The toner obtained according to the present invention has a volume-median particle size ($D_{50}$) of from 3.5 to 7 μm, preferably from 3.5 to 6.5 μm, and more preferably from 4 to 6 μm, from the viewpoint of achieving higher image qualities.

In addition, the toner has a standard deviation in the volume base particle size distribution of preferably ¼ or less that of $D_{50}$, and more preferably from ⅐ to ¼ that of $D_{50}$, from the viewpoint of securing excellent dot reproducibility regardless of the particle size of the toner in the above-mentioned particle size range.

The particle having a particle size of $(1.4 \times D_{50})$ μm or more, of which toner scattering is likely to be more outstanding around the dots, is contained in an amount of 5% by volume or less, and preferably 4% by volume or less, in the toner. On the other hand, the particle having a particle size of 3 μm or less is contained in an amount of 5% by number or less, and preferably 4% by number or less, in the toner, from the viewpoint of preventing the lowering of dot reproducibility due to continuous printing.

The toner obtainable by the present invention can be used without particular limitation in any of the development method alone as a toner for magnetic monocomponent development in the case where fine magnetic material powder is contained, or as a toner for nonmagnetic monocomponent development or as a toner for two-component development by mixing the toner with a carrier in the case where fine magnetic material powder is not contained.

The toner of the present invention can be excellently fixed by an oil-less fixing process. Here, the oil-less fixing process refers to a process for fixing a toner with an apparatus containing a heat roller fixing device but without an oil-feeding device, or the like. The oil-feeding device includes a device equipped with an oil tank, having mechanism of applying an oil to a heat roller surface in a given amount, a device having mechanism so that a roller previously immersed in an oil is brought into contact with a heat roller, and the like.

Accordingly, the present invention further provides a process for forming fixing images, including the step of fixing the toner of the present invention by an oil-less fixing process. The process for forming fixing images in the present invention allows the fixing images to be formed through known steps except that the fixing step including a step of fixing a transferred toner image has the above feature. Representative steps in the process for forming fixing images include the steps of forming an electrostatic latent image on the surface of a photoconductor (charging and exposing step); developing an electrostatic latent image (developing step); transferring the developed toner image to a material to be transferred such as paper (transferring step); removing the toner remaining on a developing member such as a photoconductive drum (cleaning step), and the like.

EXAMPLES

The following examples further describe and demonstrate embodiments of the present invention. The examples are given solely for the purposes of illustration and are not to be construed as limitations of the present invention.

[Softening Point]

The softening point refers to a temperature corresponding to h/2 of the height (h) of the S-shaped curve when plotting a downward movement of a plunger (flow length) against temperature, namely, a temperature at which a half of the resin flows out, when measured by using a flow tester (CAPILLARY RHEOMETER "CFT-500D," commercially available from Shimadzu Corporation), in which a 1 g sample is extruded through a nozzle having a die pore size of 1 mm and a length of 1 mm, while heating the sample so as to raise the temperature at a rate of 6° C./min and applying a load of 1.96 MPa thereto with the plunger.

[Glass Transition Temperature of Resins]

The glass transition temperature refers to a temperature of an intersection of the extension of the baseline of equal to or lower than the temperature of the maximum endothermic peak and the tangential line showing the maximum inclination between the kick-off of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a rate of 10° C./min.

[Volume-Median Particle Size ($D_{50}$) of Pulverized Product]

(1) The amount 100 g of the pulverized product is sifted through sieves having openings of 2000 μm, 1000 μm, 850 μm, 500 μm, 355 μm, 250 μm, 150 μm, 75 μm, and 45 μm. The sifting is started from a sieve having the largest opening, and the pulverized product which passes through the sieve is sifted with sieves in the order of descending sizes from large opening to small opening.

(2) The weight of the pulverized product remaining on each sieve is determined to calculate a mass base frequency (%).

(3) The volume-median particle size ($D_{50}$) of the pulverized product is calculated according to the following formula:

$$
\begin{aligned}
D_{50}(\mu m) = {} & 2000 \times (\text{mass base frequency of pulverized product on a sieve having an opening of } 2000\ \mu m) + \\
& 1000 \times (\text{mass base frequency of pulverized product on a sieve having an opening of } 1000\ \mu m) + \\
& 850 \times (\text{mass base frequency of pulverized product on a sieve having an opening of } 850\ \mu m) + \\
& 500 \times (\text{mass base frequency of pulverized product on a sieve having an opening of } 500\ \mu m) + \\
& 355 \times (\text{mass base frequency of pulverized product on a sieve having an opening of } 355\ \mu m) + \\
& 250 \times (\text{mass base frequency of pulverized product on a sieve having an opening of } 250\ \mu m) + \\
& 150 \times (\text{mass base frequency of pulverized product on a sieve having an opening of } 150\ \mu m) + \\
& 75 \times (\text{mass base frequency of pulverized product on a sieve having an opening of } 75\ \mu m) + \\
& 45 \times (\text{mass base frequency of pulverized product on a sieve having an opening of } 45\ \mu m)
\end{aligned}
$$

[Number-Average Particle Size of Wax]

The cross section of the toner is photographed with a TEM (transmission electron microscope) at a magnification of 2500 times. One hundred particles of wax are observed for determination of the maximum particle size, and a number average is taken to calculate a number-average particle size of the wax.

[Particle Size Distribution of Toner]

The particle size distribution of the toner is determined with a coulter counter "Coulter Multisizer II" (commercially available from Beckman Coulter) according to the following method.

(1) Preparation of Dispersion: 10 mg of a sample to be measured is added to 5 ml of a dispersion medium (a 5% by weight aqueous solution of "EMULGEN 109P" (commercially available from Kao Corporation, polyoxyethylene lauryl ether, HLB: 13.6)), and dispersed with an ultrasonic disperser for one minute. Thereafter, 25 ml of electrolytic solution ("Isotone II" (commercially available from Beckman Coulter)) is added thereto, and the mixture is further dispersed with the ultrasonic disperser for one minute, to give a dispersion.

(2) Measuring Apparatus: Coulter Multisizer II (commercially available from Beckman Coulter)

Aperture Diameter: 100 μm

Range of Particle Sizes to Be Determined: 2 to 60 μm

Analyzing Software: Coulter Multisizer AccuComp Ver. 1.19 (commercially available from Beckman Coulter)

(3) Measurement Conditions: One-hundred milliliters of an electrolyte and a dispersion are added to a beaker, and the particle sizes of 30000 particles are determined under the conditions for concentration satisfying that the determination for 30000 particles are completed in 20 seconds.

(4) The volume-median particle size ($D_{50}$, μm), the content (% by volume) of the particles having particle sizes of ($1.4 \times D_{50}$) μm or more, the content (% by number) of the particles having particle sizes of 3 μm or less, and the standard deviation in the volume base particle size distribution are obtained from the found values.

Preparation Example of Resin

The amount 568 g of polyoxypropylene(2.2)-2,2-bis(4-hydroxyphenyl)propane, 792 g of polyoxyethylene(2.2)-2,2-bis(4-hydroxyphenyl)propane, 640 g of terephthalic acid, and 10 g of tin octylate were reacted at 210° C. under a nitrogen gas stream while stirring. The degree of polymerization was monitored by the softening point, and the reaction was terminated when the softening point reached 110° C. The resulting resin is referred to as a resin A. The resin A had a glass transition temperature of 68° C.

Example 1

One hundred parts by weight of the resin A, 4.5 parts by weight of a colorant "ECB-301" (commercially available from DAINICHISEIKA COLOR & CHEMICALS MFG. CO., LTD.), 4.0 parts by weight of a releasing agent "Carnauba Wax C1" (commercially available from Kato Yoko), 3.0 parts by weight of a paraffin wax "HNP-9" (commercially available from Nippon Seiro), and 0.2 parts by weight of a charge control agent "BONTRON E-304" (commercially available from Orient Chemical Co., Ltd.) were mixed with a 150 liter Henschel mixer at 720 r/min for 180 seconds (Fr·t=14,256), and the resulting mixture was kneaded with a continuous twin open-roller type kneader "Kneadex" (commercially available from MITSUI MINING COMPANY, LIMITED), to give a kneaded mixture.

Incidentally, the continuous twin open-roller type kneader used has a roller having an outer diameter of 0.14 m and an effective length of 0.8 m, and the operating conditions are a rotational speed of a higher rotation side roller (front roller) of 75 r/min, a rotational speed of a lower rotation side roller (back roller) of 50 r/min, and a gap between the rollers of 0.1 mm. The temperatures of the heating medium and the cooling medium inside the rollers are as follows. The higher rotation side roller has a temperature at the raw material introducing side of 150° C., and a temperature at the kneaded mixture discharging side of 130° C., and the lower rotation side roller has a temperature at the raw material introducing side of 35° C., and a temperature at the kneaded mixture discharging side of 30° C. In addition, the feeding rate of the raw material mixture was 10 kg/hour.

Next, the resulting kneaded mixture was cooled in the air, and thereafter the cooled mixture was roughly pulverized with Alpine Rotoplex (commercially available from Hosokawa Micron Corporation), to give a roughly pulverized product having the maximum particle size of 2 mm.

The resulting mixture was finely pulverized and classified by cutting off its upper limit (removal of coarse powers) with a counter jet mill "400AFG" (commercially available from Hosokawa Micron Corporation).

Further, the finely pulverized product was classified by cutting off its lower limit (removal of fine powers) with a classifier "TTSP" (commercially available from Hosokawa Micron Corporation), to give a toner. The particle size distribution of the resulting toner and the particle size of the dispersed phases of the wax are shown in Table 2. In addition, productivity was evaluated from the yield of toner to the roughly pulverized product in accordance with the following evaluation criteria. The results are shown in Table 2.

[Evaluation Criteria for Productivity]

◎: 70 to 100% by weight

○: 50% by weight or more and less than 70% by weight

Δ: 40% by weight or more and less than 50% by weight x: 20% by weight or more and less than 40% by weight xx: Less than 20% by weight Further, 0.5 parts by weight of a hydrophobic silica "R972" (commercially available from Nippon Aerosil) were externally added to 100 parts by weight of the toner with a Henschel mixer.

Example 2

The same procedures as in Example 1 were carried out except that the amount of "Carnauba Wax C1" was changed to 7.0 parts by weight and the amount of "HNP-9" was changed to 4.0 parts by weight to give a toner, and the hydrophobic silica was externally added thereto.

Example 3

The same procedures as in Example 1 were carried out except that a jet mill pulverizer "IDS-5" (commercially available from Nippon Pneumatic Mfg. Co., Ltd.) was used in place of the counter jet mill "400AFG," to give a toner, and the hydrophobic silica was externally added thereto.

Example 4

The same procedures as in Example 1 were carried out except that a jet mill pulverizer "IDS-5" (commercially available from Nippon Pneumatic Mfg. Co., Ltd.) was used in place of the counter jet mill "400AFG", and a dispersion separator "DS" (commercially available from Nippon Pneumatic Mfg. Co., Ltd.) was used as a classifier in place of "TTSP," to give a toner, and the hydrophobic silica was externally added thereto.

Example 5

The same procedures as in Example 1 were carried out except that a mechanical pulverizer "Turbo-Mill T-400RSS" (commercially available from TURBO KOGYO CO., LTD., clearance: 0.7 mm) was used in place of the counter jet mill "400AFG," to give a toner, and the hydrophobic silica was externally added thereto.

Comparative Example 1

The same procedures as in Example 1 were carried out except that the amount of "Carnauba Wax C1" was changed to 10.0 parts by weight and the amount of "HNP-9" was changed to 8.0 parts by weight, to give a toner, and the hydrophobic silica was externally added thereto.

Comparative Example 2

The same procedures as in Example 1 were carried out except that a twin-screw kneader having a heating temperature inside the roller of 100° C. was used as a kneader in place of the open-roller type kneader, to give a toner, and the hydrophobic silica was externally added thereto.

Comparative Example 3

The same procedures as in Example 1 were carried out except that the toner having the particle size distribution shown in Table 2 was prepared by changing the classification conditions, to give a toner, and the hydrophobic silica was externally added thereto.

Comparative Example 4

The same procedures as in Example 4 were carried out except that the toner having the particle size distribution shown in Table 2 was prepared by changing the classification conditions, to give a toner, and the hydrophobic silica was externally added thereto.

Comparative Example 5

The same procedures as in Example 1 were carried out except that "HNP-9" was not used, and the mixture was kneaded with a twin-screw kneader having a heating temperature inside the roller of 100° C. as a kneader in place of the open-roller type kneader, thereafter the kneaded product was roughly pulverized, and further the roughly pulverized product was again kneaded with the twin-screw kneader having a heating temperature inside the roller of 100° C., to give a toner, and the hydrophobic silica was externally added thereto.

TABLE 1

[Correlation Table of Preparation Conditions]

| Ex. No. | Amount of Carnauba Wax (Parts by Weight) | Amount of Paraffin Wax (Parts by Weight) | Kneader | Pulverizer | Classifier |
|---|---|---|---|---|---|
| 1 | 4.0 | 3.0 | Open roller | 400AFG | TTSP |
| 2 | 7.0 | 4.0 | Open roller | 400AFG | TTSP |

TABLE 1-continued

[Correlation Table of Preparation Conditions]

| | Amount of Carnauba Wax (Parts by Weight) | Amount of Paraffin Wax (Parts by Weight) | Kneader | Pulverizer | Classifier |
|---|---|---|---|---|---|
| 3 | 4.0 | 3.0 | Open roller | IDS-5 | TTSP |
| 4 | 4.0 | 3.0 | Open roller | IDS-5 | DS |
| 5 | 4.0 | 3.0 | Open roller | T-400RSS | TTSP |

TABLE 1-continued

[Correlation Table of Preparation Conditions]

| | Amount of Carnauba Wax (Parts by Weight) | Amount of Paraffin Wax (Parts by Weight) | Kneader | Pulverizer | Classifier |
|---|---|---|---|---|---|
| Comp. Ex. No. | | | | | |
| 1 | 10.0 | 8.0 | Open roller | 400AFG | TTSP |
| 2 | 4.0 | 3.0 | Twin Screw | 400AFG | TTSP |
| 3 | 4.0 | 3.0 | Open roller | 400AFG | TTSP |
| 4 | 4.0 | 3.0 | Open roller | IDS-5 | DS |
| 5 | 4.0 | — | Twin Screw (Double kneading) | 400AFG | TTSP |

Test Example 1

A toner was loaded to a printer "MicroLine 9500PS" (commercially available from Oki Data Corporation, resolution: 1200 dpi×1200 dpi) and half tone fixed images (with halftone cells of 2×2 dots) were printed. The evenness of the half tone was visually judged, thereby evaluating initial dot reproducibility in accordance with the following evaluation criteria. Further, fixed images having a printing ratio of 5% were continuously printed for 6000 sheets, and thereafter, the same half tone images as those in the initial printing were again printed. The dot reproducibility was evaluated. The results are shown in Table 2.

TABLE 2

| | Particle Size Distribution | | | | | | Number-Average Particle Size of Wax (μm) | Dot Reproducibility | | |
|---|---|---|---|---|---|---|---|---|---|---|
| | | Particles Having Particle Sizes of (1.4 × $D_{50}$) μm or More | | Particles Having Particle Sizes of 3 μm or Less | | Standard Deviation in Volume Base Particle Size Distribution | | | After 6000 | |
| | $D_{50}$ | 1.4 × $D_{50}$ | Content (% by Volume) | Content (% by Number) | $D_{50}$ × ¼ | | | Initial Printing | Sheets of Printing | Productivity |
| Ex. No. | | | | | | | | | | |
| 1 | 4.6 | 6.4 | 1.0 | 3.4 | 1.15 | 1.1 | 0.5 | ◎ | ◎ | ◎ |
| 2 | 5.3 | 7.4 | 3.5 | 1.6 | 1.325 | 1.2 | 0.8 | ◎ | ○ | ◎ |
| 3 | 6.1 | 8.5 | 3.2 | 1.8 | 1.525 | 1.3 | 0.5 | ○ | ○ | ◎ |
| 4 | 6.3 | 8.8 | 3.4 | 4.1 | 1.575 | 1.4 | 0.5 | ○ | ○ | ○ |
| 5 | 6.7 | 9.4 | 4.1 | 1.9 | 1.675 | 1.4 | 0.3 | Δ | Δ | ○ |
| Comp. Ex. No. | | | | | | | | | | |
| 1 | 6.5 | 9.1 | 5.5 | 2.5 | 1.625 | 1.8 | 1.5 | Δ | X | X |
| 2 | 7.1 | 9.9 | 10.2 | 3.5 | 1.775 | 2.2 | 2.5 | X | XX | XX |
| 3 | 7.5 | 10.5 | 5.5 | 3.2 | 1.875 | 1.5 | 0.5 | X | X | ◎ |
| 4 | 6.6 | 9.2 | 3.8 | 6.7 | 1.65 | 1.8 | 0.5 | Δ | XX | ○ |
| 5 | 5.7 | 8.0 | 3.8 | 2.7 | 1.425 | 1.4 | 1.0 | ○ | Δ | XX |

[Evaluation Criteria for Dot Reproducibility]
◎: The half tone is overall even and uniform.
○: The half tone is almost even without uniformity partially.
Δ: The half tone is found to contain non-uniformity in certain portions, with granular feel.
X: The half tone has large non-uniformity and granular feel.
XX: The half tone has very large non-uniformity and granular feel.

It can be seen from the above results that the toner obtained by Examples has excellent dot reproducibility and excellent productivity, as compared with the toners obtained by Comparative Examples.

The toner obtainable by the present invention can be used, for instance, for the development of a latent image formed in electrophotography, electrostatic recording method, electrostatic printing method or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for preparing a toner comprising:

(I) melt-kneading a raw material mixture comprising a resin binder, a wax, and a colorant with an open-roller type kneader;

(II) cooling the melt-kneaded mixture obtained in the step (I) and pulverizing the cooled mixture; and (III) classifying the pulverized product obtained in the step (II) to give a toner, wherein the wax is contained in the toner in an amount of from 2 to 15% by weight of the resin binder, and has a number-average particle size in the toner of 1 μm or less, wherein the toner has a volume-median particle size ($D_{50}$) of from 3.5 to 7 μm, and a standard deviation in volume base particle size distribution of ¼ of $D_{50}$ or less, and contains 5% by volume or less of particles having particle sizes of($1.4\times D_{50}$) μm or more, and 5% by number or less of particles having particle sizes of 3 μm or less.

2. The process according to claim 1, wherein the step (III) comprises classifying the pulverized product with a classifier, the classifier comprising a classifying rotor comprising a driving shaft arranged in a casing as a central shaft thereof in a vertical direction; and a stationary spiral guiding vane arranged to share the same central shaft as the classifying rotor, wherein the stationary spiral guiding vane is arranged in the classification zone on an outer circumference of the classifying rotor with a given spacing to the outer circumference of the classifying rotor.

3. The process according to claim 1, wherein the pulverization in the step (II) comprises rough pulverization and fine pulverization, the fine pulverization comprising finely pulverizing the roughly pulverized product with a jet type pulverizer.

4. The process according to claim 1, wherein the pulverized product obtained by the step (II) has a particle size of from 3 to 6.5 μm.

5. The process according to claim 1, wherein the resin binder is a polyester having a softening point of from 80° to 165° C., and wherein the wax comprises at least one natural ester wax, at least one petroleum wax or a mixture thereof.

6. The process according to claim 1, wherein the wax comprises a natural ester wax and a petroleum wax.

7. The process according to claim 1, wherein a temperature of a heat roller of the open-roller type kneader in the step (I) is from 80° to 200° C., and a temperature of a cooling roller of the open-roller type kneader in the step (I) is from 20° to 140° C.

8. The process according to claim 1, wherein the resin binder and the wax are mixed together before the step (I) under the condition that a value of (Froude number of apparatus×agitation time (s)) is from 10,000 to 30,000.

9. The process according to claim 1, wherein the peripheral speed of the open-roller type kneader in the step (I) is from 2 to 100 r/min.

10. The process according to claim 2, wherein a fine powder is removed with the classifier.

11. A toner comprising a resin binder, a colorant and a wax, wherein the wax is contained in the toner in an amount of from 2 to 15% by weight of the resin binder, and has a number-average particle size in the toner of 1 μm or less, wherein the toner has a volume-median particle size ($D_{50}$) of from 3.5 to 7 μm, and a standard deviation in volume base particle size distribution of the toner is ¼ of $D_{50}$ or less, and contains 5% by volume or less of particles having particle sizes of($1.4\times D_{50}$) μm or more, and contains 5% by number or less of particles having particle sizes of 3 μm or less.

12. A process for forming fixing images, comprising the step of fixing an image obtained by the toner as defined in claim 11 by an oil-less fixing process.

13. The process according to claim 1, wherein the pulverized product obtained in step (II) has a particle size of from 3 to 6.5 μm.

14. The process according to claim 1, wherein the pulverized product obtained in step (II) has a particle size of from 3.5 to 6 μm.

15. The process according to claim 1, wherein $D_{50}$ is from 3.5 to 6.5 μm.

16. The process according to claim 1, wherein $D_{50}$ is from 4 to 6 μm.

17. The process according to claim 1, wherein the standard deviation in volume base particle size distribution is from ⅐ to ¼ that of $D_{50}$.

18. The process according to claim 1, wherein the pulverized product contains 4% by volume or less of particles having particle sizes of($1.4\times D_{50}$) μm or more.

19. The process according to claim 1, wherein the pulverized product contains 4% by number or less of particles having particle sizes of 3 μm or less.

20. The process according to claim 1, wherein the wax has a number-average particle size in the toner of from 0.5 to 0.6 μm.

* * * * *